United States Patent [19]

Neuman

[11] 4,362,132

[45] Dec. 7, 1982

[54] TWO-CYCLE ENGINE

[76] Inventor: Clayton L. Neuman, 11440 Olive St., Coon Rapids, Minn. 55433

[21] Appl. No.: 224,256

[22] Filed: Jan. 12, 1981

[51] Int. Cl.[3] ..... F02B 33/04

[52] U.S. Cl. ..... 123/73 D; 123/73 R; 123/73 V; 123/73 DA; 123/73 AF; 123/65 P

[58] Field of Search ..... 123/73 V, 73 AE, 73 D, 123/73 AA, 73 R, 65 P

[56] References Cited

FOREIGN PATENT DOCUMENTS

| | | | |
|---|---|---|---|
| 872413 | 4/1953 | Fed. Rep. of Germany | 123/73 D |
| 954654 | 12/1956 | Fed. Rep. of Germany | 123/73 D |
| 834034 | 5/1960 | United Kingdom | 123/73 D |

*Primary Examiner*—Wendell E. Burns

*Attorney, Agent, or Firm*—Merchant, Gould, Smith, Edell, Welter & Schmidt

[57] ABSTRACT

A two-cycle engine is disclosed which conventionally includes a piston that reciprocates between a closed combustion chamber and crankcase. The piston reciprocates through a connecting rod that is eccentrically connected to the crank discs of a crankshaft. The crankcase is partially circular in configuration, and the crank-discs conform in shape to the crankcase. Each crank disc has an annular recess or pocket extending around its periphery for approximately 180° and in opposition to the eccentric point of connection of the connecting rod. The pockets cyclically communicate with a fuel inlet port and carburetor, both of which are positioned below the crankshaft rotational axis on the downstroke side of the crankcase. Fuel transfer passages between the crankcase and combustion chamber are positioned to receive the fuel charge from each recess as it is thrown tangentially upward with rotation of the crank discs.

22 Claims, 10 Drawing Figures

TWO-CYCLE ENGINE

The invention relates generally to internal combustion engines, and is specifically directed to a two cycle internal combustion engine including means for transferring a fuel charge from the crankcase to the combustion chamber more quickly and efficiently.

Conventional two-cycle engines normally include a combustion chamber and substantially closed crankcase with a piston sealably disposed therebetween and reciprocally movable so that the volume of these two chambers is inversely varied. A carburetor is mounted on the engine housing and communicates directly with the crankcase to provide pulsed fuel charges in a predetermined fuel-air ratio. The fuel charge reaches the combustion chamber through transfer passages leading from the crankcase and opening within the combustion chamber through transfer ports. An exhaust port leads from the combustion chamber to an exhaust manifold. Through its reciprocation, the piston controls the intake of fuel and the exhaust of combusted gases as it moves relative to the transfer and exhaust ports, which are disposed within the combustion chamber for proper sequential operation.

In the conventional engine, as the piston moves on its upstroke, the fuel charge admitted to the combustion chamber is compressed, the transfer and exhaust ports both being closed as the piston approaches top dead center of its stroke.

While the combustion chamber is being reduced in volume by upward piston movement, the volume of the crankcase expands, and the resulting decrease in pressure serves to draw a charge of fuel from the carburetor into the crankcase.

During the ensuing downstroke of the piston, which is initiated by ignition of the compressed fuel charge within the combustion chamber, the exhaust port is initially opened to release combusted gases. Immediately thereafter, the piston begins to uncover the transfer ports to permit the entry of a new fuel charge in the crankcase. The fuel charge transfer is effected by compression of the crankcase as the piston moves downward, forcing the fuel charge upward through the transfer passages. At the same time, pressure within the combustion chamber is decreasing because its volume increases with downward piston movement. This pressure differential is instrumental in conventional two-cycle engines in the transfer of the fuel charge to the combustion chamber.

An inherent problem with two-cycle engines results directly from the occurrence of both the exhaust of combusted gases and the intake of a fresh fuel charge on the piston downstroke. It is of course highly important that the fuel charge reach the combustion chamber as quickly as possible, and that the charge be uniformly distributed within the combustion chamber prior to ignition for maximum power output and efficiency. To this end, and from only the standpoint of fuel intake, it is advantageous for the fuel transfer ports to be opened as soon as possible on the piston downstroke and to remain open for a substantial portion of the downstroke, thus permitting the fuel charge to begin entering as soon as possible and to continue entering as the piston continues its downstroke.

However, because the exhaust cycle also occurs on the piston downstroke, the premature entry of the fuel charge into the combustion chamber can cause part of the charge to be exhausted with the combusted gases. This not only decreases the available fuel charge for ignition and combustion, which obviously reduces power of the engine, but also emits unburned hydrocarbons into the atmosphere, which is a primary cause of air pollution.

The lower part of the transfer port may be extended to a low position within the combustion chamber, which gives the fuel charge a little more time to enter the combustion chamber as the piston moves downward, but this necessitates a substantial downward piston stroke. Increasing the piston downstroke cannot be accomplished without a number of disadvantages.

The invention is directed to an internal combustion engine which utilizes conventional components of the engine in such a way that the fuel charge is transferred much more quickly into the combustion chamber, resulting in increased power and more efficient operation. More specifically, the invention contemplates the use of the crank discs on the crankshaft for the receipt and delivery of a fuel charge, with the high rotational speed of the crankshaft causing the fuel charge to be circumferentially carried and tangentially thrown through the transfer channels into the combustion chamber.

In the inventive engine, the crankcase is of partially circular configuration, and the crank discs are sized and positioned for rotation in close proximity to the circular inner surface of the crankcase.

Each of the crank discs is formed with a peripheral fuel pocket, which in the preferred embodiment occupies substantially one-half or 180° of the crank disc periphery. The fuel pockets are disposed diametrically opposite the eccentric point at which the connecting rod is connected to the crank discs.

The carburetor and fuel inlet port are positioned low relative to the crankcase. Preferably, the fuel inlet port leading into the crankcase is below the crankshaft axis of rotation, and it is positioned on the downstroke side of the crankcase; i.e., the side which is passed by the eccentric rod connection as the piston moves through its downstroke.

As constructed, the fuel pockets begin receiving a fuel charge from the carburetor at the time the piston begins its upward stroke movement, and exposure of the fuel pockets to the carburetor inlet port continues through the upstroke until a time just after the piston begins its downstroke. This generally corresponds to the time during which a fuel charge is admitted to the crankcase in a conventional two-cycle engine.

However, in the inventive engine, as the piston begins its downstroke, the leading edge of the peripheral fuel pockets begins to approach the upper part of the crankcase. In this region, the crankcase side diverts smoothly away from the circular configuration and toward the crankcase inlet ports of the transfer channels. Accordingly, the fuel pockets, no longer being confined by the crankcase side, are able to throw the previously contained fuel charge tangentially upward into the transfer channels. Because of the centrifugal force exerted on the fuel charge by the rotating crank discs, the fuel charge is forced into the combustion chamber much more quickly and thoroughly, resulting in increased power output during the combustion cycle and increased efficiency.

The inventive engine also makes use of a unique arrangement of fuel transfer and exhaust ports within the combustion chamber. Two primary front transfer ports open from two primary, symmetrically opposed transfer channels. Next adjacent are a pair of symmetrically opposed side transfer ports leading from a second pair of transfer channels. Symmetrically adjacent the side transfer ports are a pair of piston transfer channels that respectively communicate with a pair of piston ports formed through the piston side. This structural arrangement makes use of pressure within the crankcase to force additional fuel into the combustion chamber through the piston itself.

The front and side transfer ports and the piston transfer channels are circumferentially spaced around the inner surface of the combustion chamber, occupying all but the area taken by a main exhaust port, which is disposed diametrically opposite the two piston transfer channels. Disposed circumferentially adjacent the main exhaust port but over the front transfer ports are a pair of side exhaust ports which commonly communicate with the main exhaust passage at a point remote from the combustion chamber.

I have found that the inventive two-cycle engine is capable of producing more power than conventional two-cycle engines of comparable size, particularly at higher revolutions per minute. This is believed to be the result of the commensurately increased centrifugal forces exerted on the fuel charges as they are thrown upwardly through the transfer channels into the combustion chamber. In addition, due to the quicker fuel transfer and circumferential spacing of the transfer ports, the fuel charge is timed properly and distributed uniformly throughout the combustion chamber prior to ignition, and this optimizes the combustive force and the thoroughness of combustion. As a result, performance is increased and fewer unburned hydrocarbons are exhausted to atmosphere.

Figure 1:
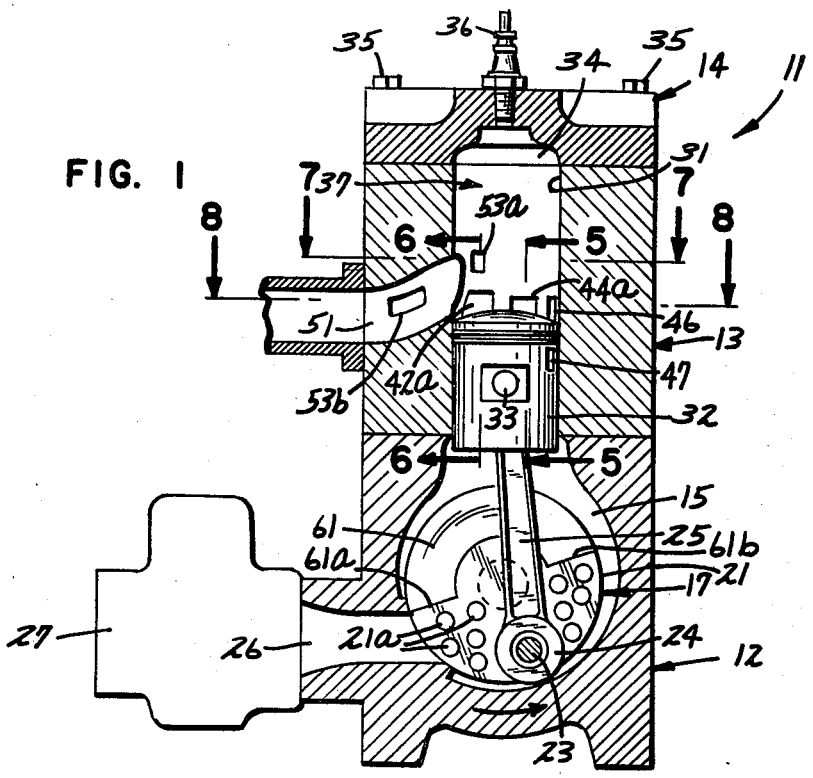
FIG. 1 is a diagrammatic sectional view of a two-cycle internal combustion engine embodying the inventive concept and shown at the beginning of the intake and combustion stroke.

With initial reference to FIG. 1, a two-cycle internal combustion engine embodying the invention is represented generally by the numeral 11. Engine 11 broadly comprises an engine housing consisting of a crankcase section 12, a cylinder section 13 and a head section 14.

The crankcase section 12 defines a crankcase 15 which generally takes the shape of a cylindrical chamber (see also FIG. 3) having a horizontal axis 16.

Throughout the specification, the terms "horizontal" and "vertical" are used to describe the orientation of various components as viewed in the several figures. It will be appreciated that these descriptive terms are used to facilitate an understanding of the structure, and since the engine can assume various positions other than that disclosed, these terms should not be interpreted as limiting the invention scope.

Figure 3:
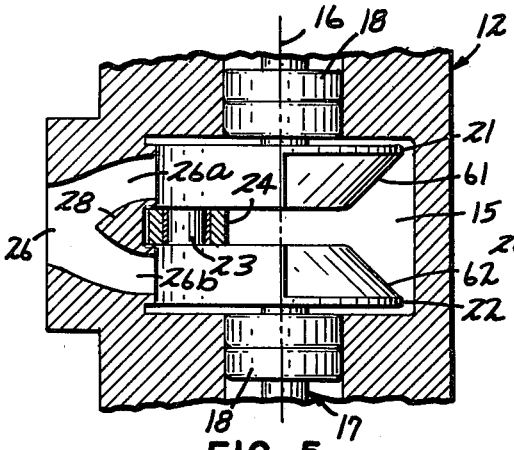
FIG. 3 is an enlarged fragmentary sectional view as viewed in a plane passing through the axis of the engine crankshaft with the engine operating in the power and exhaust stroke.

With continued reference to FIGS. 1 and 3, a crankshaft 17 is rotatably carried within the crankcase section 12 by two sets of main bearings 18. Crankshaft 17 rotates about axis 16.

Crankshaft 17 further comprises a pair of crank discs 21, 22 that are eccentrically joined by a crank pin 23. A crank bearing 24 mounted on the pin 23 serves as a rotational connection for a piston connecting rod 25.

A fuel inlet port or passage 26 is formed in the crankcase section 12, establishing communication between the crankcase and a carburetor 27. Port 26 is disposed below the axis 16, extending substantially horizontally from a lower point on the inner cylindrical surface of crankcase 15.

As shown in FIG. 3, fuel inlet port 26 is divided as it approaches the cylindrical surface of crankcase 15, thus defining separate passages **26*a*, 26*b*. These passages are separated by a residual structural member 28**.

Carburetor 27 is of conventional design, and its internal structure is not specifically disclosed.

Cylinder section 13 defines a vertically disposed cylinder chamber 31 in which a conventional piston 32 is reciprocally disposed. Piston 32 is pivotally connected to the connecting rod 25 by a wrist pin 33, permitting the reciprocating piston 32 to impart rotational motion to the crankshaft 17 in the usual manner.

Head section 14 defines a closed head chamber 34 which is aligned with the cylinder chamber 31, forming therewith a variable volume engine combustion chamber. Head section 14 is bolted to the cylinder section 13 by a plurality of head bolts 35. A head gasket (not shown) is sealably compressed between the sections 13, 14 in the known manner. A conventional spark plug 36 projects into the head chamber 34 to ignite the compressed fuel charge in a timed manner, all as known in the prior art.

As constructed, the piston 32 serves to inversely vary the volume of the combustion chamber (hereinafter referred to by reference numeral 37) and the crankcase chamber 15 through combined cycles of intake, compression, combustion and exhaust. As is typical with two-cycle engines, the fuel charge consists of an oil, gasoline and air mixture introduced through the carburetor 27 into the crankcase chamber 15, and this fuel charge is transferred to the combustion chamber 37 during the downward stroke of the piston through a plurality of transfer passages shown in FIGS. 1, 5–6 and 8–10.

Figure 10:
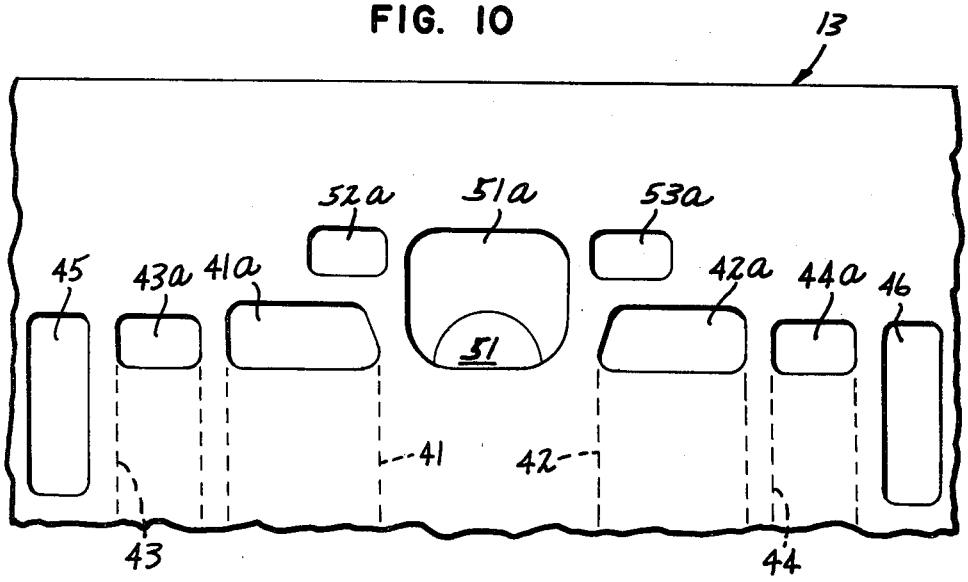
FIG. 10 is an enlarged, fragmentary generated view specifically showing the relationship of all transfer and exhaust passages.

As shown in the generated view of FIG. 10, these transfer passages include a pair of symmetrically disposed front transfer channels or passages 41, 42 formed vertically within the cylinder section 13 and respectively terminating in front transfer ports 41*a*, 42*a* that open on the face of cylinder chamber 31. The channels 41, 42 open into the crankcase 15 through inlet ports 41*b*, 42*b*.

A pair of side transfer channels 43, 44 are respectively disposed adjacent the channels 41, 42. These channels 43, 44 also extend vertically within the cylinder section 13, terminating in side transfer ports 43*a*, 44*a* within the cylinder chamber 31, and inlet ports 43*b*, 44*b* in the crankcase 15.

Lastly, a pair of piston transfer channels 45–46 are vertically formed in the face of cylinder chamber 31 adjacent the side transfer channels 43, 44.

Figure 8:
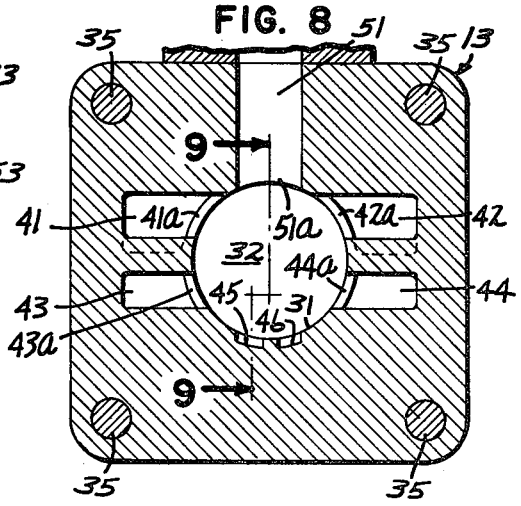
FIG. 8 is a transverse sectional view taken along the line 8—8 of FIG. 1, showing a different perspective of the transfer and main exhaust ports.

FIG. 8 shows the positions of the transfer channels 41–46 relative to each other in a plane which passes transversely through the cylinder axis. Except for the arcuate side closest to the chamber 31, the transfer channels 41–44 are rectangular in configuration when viewed in this perspective. The front transfer channels 41, 42 are symmetrically disposed in direct opposition, as are the side transfer channels 43, 44.

Figure 5:
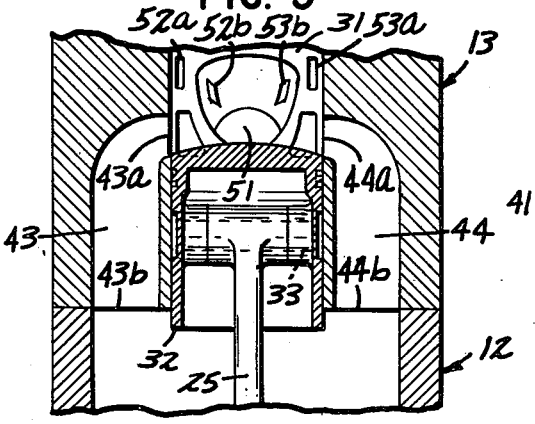
FIG. 5 is an enlarged fragmentary sectional view taken along the line 5—5 of FIG. 1, showing in particular the configuration of the transfer and exhaust ports of the engine relative to the piston and combustion chamber.
Figure 6:
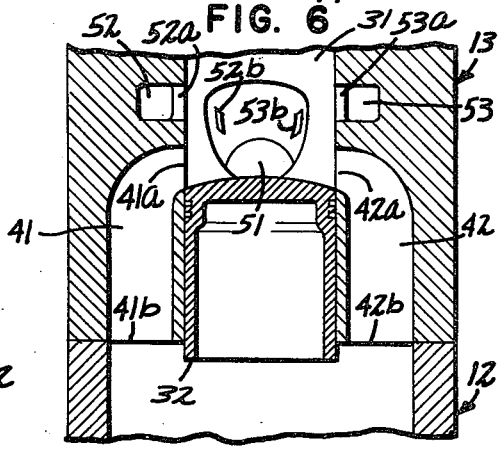
FIG. 6 is an enlarged fragmentary sectional view taken along the line 6—6 of FIG. 1, also showing the structural configuration of the transfer and exhaust ports relative to the piston and combustion chamber from a different perspective.

With reference to FIG. 5, the side transfer channels 43, 44 are shown to extend vertically upward through the cylinder section 13 from the crankcase chamber 15, with their respective upper ends curving inward to the cylinder chamber 31 and terminating in the transfer ports 43*a*, 44*a*. As shown in FIG. 6, the front transfer channels 41, 42 are similarly configured, curving inward to the transfer ports 41*a*, 42*a*.

Figure 9:
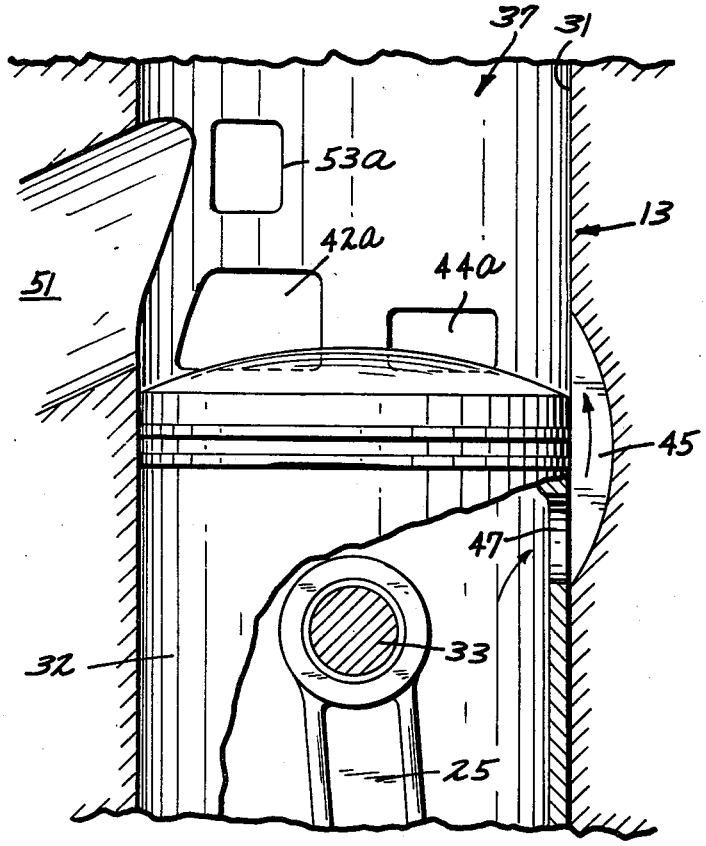
FIG. 9 is a further enlarged fragmentary sectional view taken along the line 9—9 of FIG. 8, showing in particular a piston transfer port and transfer channel.

With reference to FIGS. 9 and 10, the transfer ports 41*a*, 44*a* have bottom edges that commonly lie in a plane perpendicular to the cylinder and piston axis. However, the front transfer ports 41*a*, 42*a* are somewhat wider as viewed circumferentially of the inner surface of cylinder chamber 31 (FIG. 10), and they also have a greater axial dimension than the side transfer ports 43*a*, 44*a* (FIG. 9). As such, with the piston 32 moving on the upstroke, the transfer ports 41*a*–44*a* begin to close simultaneously, but the ports 43*a*, 44*a* close sooner than their counterparts. On the piston downstroke, the front transfer ports 41*a*, 42*a* open first, but the full open position of all of these transfer ports is reached simultaneously.

With reference to FIG. 9, the piston 32 is formed with a pair of bores 47 through its side wall, only one of which is shown. These bores 47 are positioned relatively close to the top of piston 32 and are configured and disposed to communicate with the piston transfer channels 45, 46. The circumferential width of the bores 47 is the same as its associated transfer channel 45, 46, but its axial dimension is substantially less.

As constructed and disposed, piston ports 47 establish fluid communication between the crankcase 15 and combustion chamber 37 in a timed manner through the hollow piston 32 and piston transfer channels 45, 46. As is shown in FIG. 9, with the piston 32 on its down stroke, the lower edge of piston port 47 begins communication with its associated piston transfer channel 45, 46 well prior to the time that the piston 32 begins to uncover the front and side transfer ports 41*a*–44*a*. However, fluid communication is not established between the crankcase 15 and combustion chamber 37 until the upper edge of the piston reaches the upper end of the transfer channels 45, 46. This coincides with the time at which the piston 32 begins to uncover the front transfer ports 41*a*, 42*a*. Maximum fluid communication through the piston transfer channels 45, 46 is established with the piston 32 in the position shown in FIG. 9, where the axial dimension of the piston ports 47 correspond directly with the amount of exposed area between the upper edge of the piston 32 and the upper edge of the piston transfer channels 45, 46. At this point in time, the front and side transfer ports 41*a*–44*a* are substantially open.

With reference to FIGS. 5–10, exhaust of the combusted fuel charge is through a main exhaust passage 51 and a pair of side exhaust passages 52, 53.

Figure 7:
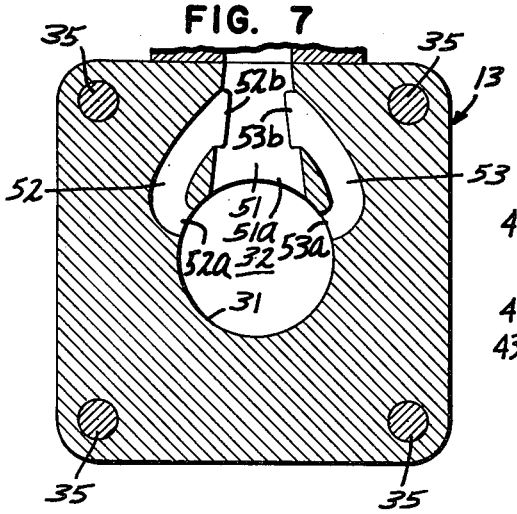
FIG. 7 is an enlarged transverse sectional view taken along the line 7—7 of FIG. 1, showing the main and side exhaust ports relative to the combustion chamber.

As best shown in FIG. 7, the side exhaust passages 52, 53 are symmetrically arranged relative to the main exhaust passage 51. These passages open on the face of cylinder chamber 31 at ports 52*a*, 53*a*, respectively, and curve smoothly outwardly and rearwardly where they intersect the main exhaust passage 51 through ports 52*b*, 53*b*, respectively.

As best shown in FIGS. 9 and 10, the main exhaust port 51*a* is centrally disposed relative to the side and front transfer ports 41*a*–44*a* and diametrically opposite the piston transfer channels 45, 46. The bottom edge of the main exhaust port 51*a* coincides with the bottom edges of the transfer ports 41*a*–44*a*, but its vertical or axial dimension is substantially greater.

The side exhaust port 52*a*, 53*a* are symmetrically disposed next adjacent the main exhaust port 51*a*, axially overlying the front transfer ports 41*a*, 42*a*, respectively. The upper edge of the ports 51*a*–53*a* commonly lie in a plane perpendicular to the axis of the piston and combustion chamber.

With reference to FIGS. 1–4, the crank discs 21, 22 are respectively formed with peripheral pockets or grooves 61, 62 the purpose of which is to receive a fuel charge from the carburetor 27, and to tangentially throw the fuel charge upwardly through the several transfer channels. As viewed in the side section of FIG. 1, fuel pocket 61 takes the form of an annular recess occupying substantially 180° of the periphery of crank disc 21. The pocket 61 is defined at one end by a flat leading surface 61*a* and at the opposite end by a flat trailing surface 61*b*. These surfaces 61*a*, 61*b* serve to confine and carry the fuel charge in a more efficient manner. Similar end surfaces, not shown, define the pocket 62.

Figure 4:
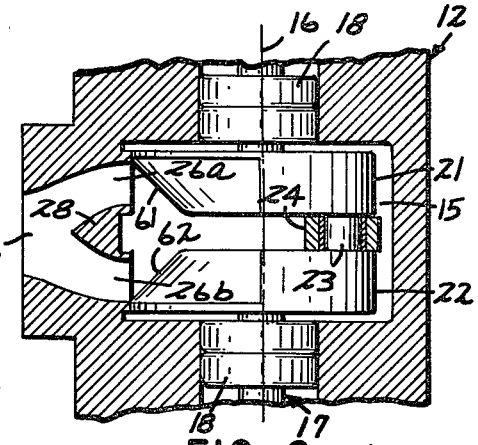
FIG. 4 is a view similar to that of FIG. 3 with the engine operating in the intake and combustion stroke.

With reference to FIGS. 3 and 4, the fuel pockets 61, 62 are shown at an angle of approximately 45° relative to the crankshaft axis, the angled surfaces inclining toward each other so that a V-shaped pocket is defined therebetween.

Figure 2:
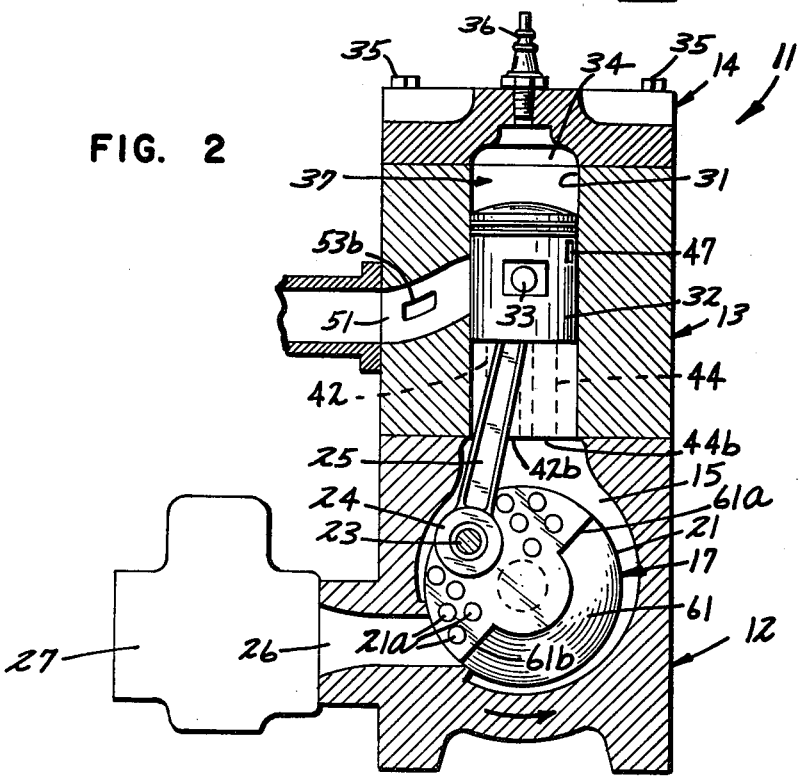
FIG. 2 is a diagrammatic sectional view similar to FIG. 1 showing the engine at the beginning of the power and exhaust stroke.

As shown in FIGS. 1 and 2, the pocket 61 (and the pocket 62) is symmetrically disposed relative to the crank pin 23 and also in diametric opposition thereto. Consequently, as the pockets 61, 62 move past the carburetor 27 to pick up the fuel charge, there is no obstruction by the connecting rod 25, which is behind the leading flat surfaces 61*a*, 62*a* as the pockets 61, 62 move relative to the carburetor 27. In FIG. 1, the leading surface 61*a* is shown at the point of initial communication with the fuel inlet port 26, and FIG. 2 shows the trailing surface 61*b* at the point when communication with the carburetor 27 ends.

For balance purposes, a number of holes 21*a* are bored into the crank disc 61 opposite the fuel pocket 61.

Similar balance holes are formed in the disc 62. Balancing the discs may be accomplished in other manners.

The fuel inlet port 26 and carburetor 27 are disposed so that delivery of the fuel charge begins when the piston 32 just begins its upward stroke. In the preferred embodiment, the fuel inlet port 26 is disposed on the downstroke side of the crankcase; i.e., that side of the crankcase through which the crank pin 23 and lower end of the connecting rod 25 move downwardly. Further, it will be seen that the fuel inlet port 26 is disposed below a horizontal plane passing through the crankshaft axis of rotation. As constructed, the fuel pockets 61, 62 carry the fuel charge circumferentially around the generally circular crankcase 15 as the piston 32 begins its downward stroke. Since the crankcase 15 is closed, pressure begins to build up because its volume is decreased. At the same time, the volume of the combustion chamber 37 is increasing inversely, thus creating a pressure differential across the piston. This is alleviated as the transfer ports **41*a*–44*a* are opened, with pressure in the crankcase 15 assisting in the transfer of the fuel charge through the transfer channels and into the combustion chamber 37**.

Transfer of the fuel charge by increasing pressure within the crankcase 15 and decreasing pressure within the combustion chamber 37 is conventional. With the improved structure, however, transfer is significantly enhanced by the centrifugal forces acting on the fuel charge created by the circumferential pockets 61, 62 rotating at high speed. As soon as the leading surface of the pockets reaches the crankcase ports **41*b*–44*b*, the fuel charge is tangentially thrown into these ports, increasing the velocity at which the fuel charge is otherwise transferred. This significantly improves the quality of fuel charge arriving at the combustion chamber 37 and as a result improves the power output of the engine 11**.

At the same time that the pockets 61, 62 begin communicating with the crankcase inlet ports **41*b*–44*b*, the connecting rod also enters that portion of the fuel pockets between the crank discs 21, 22**, assisting the tangential escape of the fuel charge upwardly towards the several transfer channels.

In the preferred embodiment, the leading surfaces of the pockets 61, 62 reach the side crankcase inlet ports **43*b*, 44*b* approximately 135° of crankshaft rotation before the piston 32 reaches top dead center, and the trailing surfaces of the pockets 61*b*, 62*b* pass out of communication with the front crankcase inlet ports 41*b*, 42*b* approximately 75° of crankshaft rotation after the piston 32 reaches top dead center. Thus, in the preferred embodiment, the fuel pockets 61, 62 are in communication with the crankcase inlet ports 41*b*–44*b* for approximately 210° of crankshaft rotation. In accordance with the invention, this exposure of the fuel pockets 61, 62 to the crankcase fuel inlet ports 41*b*–44*b* should not be less than about 200° of rotation of the crankshaft 17** or more than about 220° of crankshaft rotation.

In operation, the cycles of intake, compression, combustion and exhaust are combined and occur with one upward stroke and one downward stroke of the piston; i.e., 360° of crankshaft rotation. The intake cycle actually begins with the engine in the position shown in FIG. 1, just after the piston 32 passes by bottom dead center within the combustion chamber 37. At this point, the leading edges **61*a*, 62*a* of the fuel pockets 61, 62 just begin communication with the fuel inlet port 26, and as the piston continues its upward movement, the fuel charge is drawn from the carburetor 27 through the fuel inlet port 26 and into the fuel pockets 61, 62. The delivery of fuel stops at the point of engine operation shown in FIG. 2**, after the piston has reached top dead center and begun its downward stroke.

As the piston 32 moves upward from its bottom dead center position, the combusted gases have been substantially exhausted from the combustion chamber 37 and the piston begins to compress the fuel charge previously admitted. Compression must occur with all of the valve ports closed, and this is accomplished by the upper edge of the piston first closing off the piston transfer channels 45, 46, followed by closing off of the transfer valve ports **41*a*–44*a*. At the same time that the piston 32 begins to close off the transfer ports, it also begins to close the main exhaust port 51*a*, and with further upward movement the side exhaust ports 52*a*, 53*a* are closed. As the piston 32 reaches top dead center and passes just beyond, the spark plug 36** is fired and combustion results.

Also at the time that the piston 32 moves through its upward stroke to compress the fuel charge, a partial vacuum is created within the crankcase 15 because its variable volume has been rapidly increased. It is this partial vacuum that draws the fuel charge from the carburetor into the fuel pockets 61, 62.

Following combustion, the piston 32 begins its downward stroke, and the exhaust cycle begins. This is accomplished as the piston top edge reaches the top edge of the exhaust ports **51*a*–53*a*, and further downward movement of the piston 32 causes the combusted gases to exhaust through the passages 51–53. In this regard, the side exhaust passages 52, 53** enlarge the total exhaust area, thus increasing the volume of the combusted gases that can be handled and decreasing the time necessary for this function. This is important because the transfer of the new fuel charge begins immediately after the exhaust cycle has begun.

As the piston 32 moves further downward, it begins to open the front transfer ports **41*a*, 42*a*, which is followed shortly by opening of the side transfer ports 43*a*, 44*a* and the piston transfer channels 45, 46. When the piston reaches this point, which is shown in both FIGS. 1 and 9, it will be seen that the piston 32 has decreased the volume of the crankcase chamber 15 and increased its pressure. At the same time, the volume of the combustion chamber 37 has increased, substantially decreasing its pressure. This pressure differential between the chambers 15, 37** assists in transfer of the fuel charge in the known manner of two cycle internal combustion engines.

However, more importantly, as the piston begins to move downward from the position shown in FIG. 2, the admission of fuel from the carburetor 27 into the fuel ports 61, 62 has stopped, and the fuel charge is now being rapidly carried as the crank discs 21, 22 rotate. As shown in FIGS. 1 and 2, the circular configuration of the crankcase 15 relative to the crank discs 21, 22 assists in confining the fuel charge within the fuel pockets 61, 62 until the leading edge of the pockets approaches the crankcase inlet ports **41*b*–44*b*. In this position, which is shown in FIG. 2, it will be seen that the side wall of the crankcase 15 smoothly diverges away from the crank discs 21, 22 toward the ports 41*b*–44*b*. This enables the fuel charge to move tangentially out of the fuel pockets 61, 62 by centrifugal force, and as a result the fuel charge is thrown into the ports 41*b*–44*b*, through the transfer channels 41–44 and into the combustion chamber 37 through the transfer ports 41***a*–44*a*, which are progressively opened as the piston moves further downward.

In addition, and with reference to FIG. 9, as the piston 32 moves downward, pressure within the crankcase 15 also exists in the hollow underside of piston 32, and additional portions of the fuel charge are transferred through the piston ports 47 and piston transfer channels 45, 46 to the combustion chamber 37.

It will be appreciated from FIG. 10 that the transfer of the fuel charge occupies substantially the entire circumference of the combustion chamber 37 except for the position of the main exhaust port 51*a*. As such, not only is the fuel charge thrown into the combustion chamber 37 more quickly and efficiently by the fuel pockets 61, 62, but the fuel charge itself enters from a plurality of ports which are circumferentially spaced so that the entire combustion chamber 37 is filled. This leads to more even and more thorough combustion and results in increased power and efficiency. Because combustion is more complete, the exhaust contains fewer unburned hydrocarbons and is therefore more free of pollutants.

What is claimed is:

1. A two-cycle internal combustion engine operable through combined cycles of intake, compression, combustion and exhaust, comprising:

(a) engine housing means defining
  (i) a combustion chamber;
  (ii) and a crankcase communicating with the combustion chamber, the crankcase having a partially cylindrical configuration;
(b) piston means disposed between the combustion chamber and crankcase and reciprocally movable to inversely vary the volume thereof with reciprocation;
(c) said engine housing means further defining
  (i) transfer passage means establishing fluid communication between the combustion chamber and crankcase, the transfer passage means having inlet port means opening in the crankcase and terminating in transfer port means in the combustion chamber;
  (ii) and exhaust passage means establishing fluid communication between the combustion chamber and atmosphere and terminating in exhaust port means in the combustion chamber;
(d) the piston means being constructed and disposed to open and close the transfer and exhaust port means in accordance with said combined cycles of intake, compression, combustion and exhaust;
(e) crankshaft means rotatably carried in said housing means and including crank disc means disposed in the crankcase, the disc means being sized and configured in conformance to the partially circular configuration of the crankcase;
(f) connecting rod means for operably connecting the piston means at an eccentric point on the crank disc means so that reciprocal downstroke and upstroke movements of the piston means cause rotational movement of the crankshaft means;
(g) fuel pocket means disposed on the periphery of the crank disc means in substantial opposition to said eccentric point;
(h) and fuel inlet port means disposed in said engine housing for communication with the fuel pocket means;
(i) said fuel inlet port means and crank disc means being so disposed and arranged that the fuel pocket means communicates with the fuel inlet port means as the piston means moves through its upstroke;
(j) said transfer inlet port means and crank disc means being so disposed and arranged that the fuel pocket means tangentially throws its fuel charge into the transfer passage means as the piston means moves through its downstroke.

2. The two-cycle internal combustion engine defined by claim 1, wherein the fuel inlet port means is disposed on the downstroke side of the crankcase.

3. The engine defined by claim 2, wherein the transfer port means are disposed on the upstroke side of the crankcase.

4. The engine defined by claim 2, wherein:
(a) the crankshaft means has a predetermined axis of rotation;
(b) and the fuel inlet port means is disposed on the opposite side of said axis from the piston means.

5. The engine defined by claim 1, wherein the pocket means are disposed so that communication with the fuel inlet port means begins substantially when the upstroke of the piston means begins.

6. The engine defined by claim 1, wherein the pocket means are disposed so that communication with the fuel inlet port means stops substantially when the downstroke of the piston means begins.

7. The engine defined by claim 1, wherein the pocket means are in communication with the fuel inlet port means for not less than about 200 degrees of rotation of the crankshaft means.

8. The engine defined by claim 1 or 7, wherein the pocket means are in communication with the fuel inlet port means for not more than about 220 degrees of rotation of the crankshaft means.

9. The engine defined by claim 1, wherein the pocket means are in communication with the fuel inlet port means for about 200 degrees of rotation of the crankshaft means.

10. The engine defined by claim 1, wherein the pocket means comprises an annular recess occupying about 180 degrees of the periphery of the crank disc means.

11. The engine defined by claim 1, wherein the crank disc means comprises a pair of circular crank discs connected in spaced relation by a crank pin at said eccentric point, the connecting rod means being connected to the crank pin.

12. The engine defined by claim 11, wherein the pocket means comprises an annular recess formed on the periphery of each of said crank discs.

13. The engine defined by claim 12, wherein the annular recesses are disposed in mutual opposition and configured to together define a pocket of V-shaped cross section.

14. The engine defined by claim 13, wherein each of said annular recesses defines flat, radially extending leading and trailing surfaces.

15. The engine defined by claim 14, wherein the annular recesses respectively occupy about 180 degrees of the associated crank disc.

16. The engine defined by claim 1, wherein the crankcase is defined by a peripheral wall, one part of which is cylindrical relative to the axis of rotation of the crankshaft means, and another part of which diverges smoothly from the cylindrical part into communication with the combustion chamber.

17. The engine defined by claim 1, wherein the transfer passage means comprises a plurality of inlet and transfer ports and associated transfer passages symmetrically disposed relative to the axis of the combustion chamber.

18. The engine defined by claim 1, wherein:

(a) the exhaust port means comprises a main exhaust port disposed in the wall of the combustion chamber;

(b) and the transfer port means comprises (i) a pair of front transfer ports symmetrically disposed on opposite sides of the main exhaust port;

(ii) and a pair of side transfer ports disposed respectively adjacent the front transfer ports in symmetrical relation.

19. The engine defined by claim 18, wherein:

(a) the piston means comprises a hollow piston having a closed top and a cylindrical side wall;

(b) and the transfer passage means comprises (i) piston transfer channel means of predetermined length formed in the wall of the combustion chamber and opening into said combustion chamber;

(ii) and opening means formed in the cylindrical side wall of the piston in opposition to the piston transfer channel means for establishing communication through the piston and transfer channel means when the engine operates in said intake cycle.

20. The engine defined by claim 18, wherein the exhaust port means further comprises a pair of side exhaust ports symmetrically disposed on each side of the main exhaust port in overlying relation to the front transfer ports.

21. In a two-cycle engine having piston means reciprocally movable between a closed crankcase and combustion chamber by a crankshaft including crank disc means and a connecting rod connected to the crank disc means at an eccentric point, transfer passage means establishing fluid communication between the combustion chamber and crankcase, exhaust passage means establishing fluid communication between the combustion chamber and atmosphere, and fuel inlet port means, the improvement of which comprises a fuel-carrying pocket disposed on the periphery of the crank disc means in substantial opposition to said eccentric point, the fuel-carrying pocket being disposed to receive a fuel charge from the fuel inlet port means substantially during the upstroke of the piston means, and to throw said fuel charge tangentially outward into the transfer passage means as the piston means moves through its downstroke.

22. A method of supplying a fuel charge to a two-cycle internal combustion engine having piston means reciprocally movable between a closed crankcase and combustion chamber by a crankshaft including crank disc means and a connecting rod connected to the crank disc means at an eccentric point, transfer passage means establishing fluid communication between the combustion chamber and crankcase, exhaust passage means establishing fluid communication between the combustion chamber and atmosphere and fuel inlet port means, comprising the steps of:

(a) admitting a fuel charge through the fuel inlet port;

(b) receiving the fuel charge in an annular pocket formed on the periphery of the crank disc in opposition to said eccentric point substantially during the piston upstroke;

(c) carrying the fuel charge within the annular pocket circumferentially around part of the crankcase;

(d) and throwing the fuel charge tangentially outward from the annular pocket into the transfer passage means as the piston moves through its downstroke.

* * * * *